US008759647B2

(12) United States Patent
Belmondo et al.

(10) Patent No.: US 8,759,647 B2
(45) Date of Patent: Jun. 24, 2014

(54) SOUND BOARDS FOR HARPS

(75) Inventors: Armando Belmondo, Turin (IT); Giorgio Peirano, Saluzzo (IT)

(73) Assignee: N.S.M. S.p.A., Piasco (CN) (IT)

( * ) Notice: Subject to any disclaimer, the term of this patent is extended or adjusted under 35 U.S.C. 154(b) by 0 days.

(21) Appl. No.: 13/702,083

(22) PCT Filed: Jun. 15, 2011

(86) PCT No.: PCT/IB2011/052589

§ 371 (c)(1),
(2), (4) Date: Dec. 5, 2012

(87) PCT Pub. No.: WO2011/158187

PCT Pub. Date: Dec. 22, 2011

(65) Prior Publication Data

US 2013/0074672 A1 Mar. 28, 2013

(30) Foreign Application Priority Data

Jun. 15, 2010 (IT) ..... TO2010A0512

(51) Int. Cl.
*G10D 1/04* (2006.01)

(52) U.S. Cl.
USPC ..... 84/265

(58) Field of Classification Search
USPC ..... 84/192–196, 264–266, 285–289
See application file for complete search history.

(56) References Cited

U.S. PATENT DOCUMENTS

| | | | | |
|---|---|---|---|---|
| 1,817,951 A | | 8/1931 | Starke | |
| 4,796,504 A | * | 1/1989 | McWillis | 84/265 |
| 7,273,976 B2 | * | 9/2007 | Bennett | 84/285 |

FOREIGN PATENT DOCUMENTS

FR 2654859 A1 5/1991

OTHER PUBLICATIONS

Chris Waltham, Andrzej Kotlicki, Vibrational Characteristics of Harp Soundboards, Apr. 16, 2008.

* cited by examiner

*Primary Examiner* — Kimberly Lockett
(74) *Attorney, Agent, or Firm* — Robert E. Alderson, Jr.

(57) ABSTRACT

Sound boards having an elongate, approximately trapezoid shape, provided on the front face with a central longitudinal profiled string-carrier member and on the reverse side with a central profiled reinforcing member or beam, and with two side profiled members or sound bars, symmetrically disposed with respect to the reinforcing beam are provided. In such sound boards the cross-section of the reinforcing beam has a central portion with an increased height or thickness and two adjacent, symmetrical side portions or wings having a height or thickness which tapers gradually towards the outside through a concave arcuate profile up to a predetermined minimum value.

3 Claims, 5 Drawing Sheets

SOUND BOARDS FOR HARPS

CROSS-REFERENCE TO RELATED APPLICATIONS

This application is a National Phase Application of PCT International Application No. PCT/IB2011/052589, International Filing Date, Jun. 15, 2011, claiming priority to Italian Patent Application No. TO2010A000512, filed Jun. 15, 2010, both of which are hereby incorporated by reference in their entirety.

FIELD OF THE INVENTION

The present invention relates to harps, and in particular to a sound board for a harp.

More specifically, the invention relates to a sound board comprising a wooden board having an elongate, approximately trapezoid shape, provided on the front face with a central longitudinal profiled string-carrier member and on the reverse side with a central longitudinal profiled reinforcing member or beam, in particular made of a wooden material such as raw beech or the like, as well as with two side profiled members or sound bars, symmetrically disposed with respect to the beam, and wherein the cross-section of the reinforcing beam has a central portion with an increased height or thickness and two adjacent, symmetrical side portions or wings having a height or thickness which tapers gradually towards the outside through a concave arcuate profile up to a predetermined minimum value.

BACKGROUND OF THE INVENTION

In concert harps, a sound board of this type is produced by adhesively bonding about twenty planks made of (for example) spruce fir, disposed side by side, such as to obtain a wooden board having a substantially constant thickness of, for example, 1.3 cm, with a maximum width of about 55 cm and a length of about 140 cm. The external surface or side of this wooden board is then veneered with a sheet of (for example) fir, which has a thickness of the order of 1 mm and has an essentially aesthetic function. In a subsequent stage, this wooden board is tapered, like a wedge with flat surfaces, with a thickness of 10 mm at the base and of 2.5 mm at the top (including the ply of veneer).

The reinforcing beam made of (for example) raw beech is adhesively bonded on the longitudinal axis to the internal or reverse surface or side of the board thus produced, and, at the same time, the profiled string-carrier member made of (for example) evaporated beech is fastened on the axis of the external surface or side, and the string ferrules are then set into said profiled string-carrier member.

To date, sound boards for concert harps have been designed and produced in an entirely traditional manner.

SUMMARY OF THE INVENTION

It is an object of the present invention to propose a sound board produced such that it has a higher structural resistance, a greater sound output and an optimum and stable operation for a long service life.

This and other objects are achieved according to the invention by a sound board of the type defined above, which is characterized in that the abovementioned minimum value of the height or thickness of the side portions or wings of said reinforcing beam is comprised between 1 and 5 mm, and in that at least in the lower half of the reinforcing beam the transverse width of each of said side portions or wings of the reinforcing beam is comprised between about 2/3 and 3/3 of the transverse width of the central portion.

On account of these features, the reinforcing beam is generally transversely wider and more shallow or thin with respect to those of the sound boards according to the prior art.

According to a further feature, in a sound board according to the present invention, on the reverse side or back surface of said wooden board between the central reinforcing beam and each longitudinal side edge of said board there is formed a lightening recess which in plan view has an essentially triangular shape, wherein a corresponding sound bar extends.

Expediently, in said recesses the thickness of the wooden board is reduced by an amount which varies between 1% in the proximity of the upper block and 25% in the proximity of the chest-bottom.

This solution makes the sound board more elastic and makes it possible to transfer some of the deformation of the board, and therefore of the transverse stresses, from the region of the reinforcing beam towards the sound bars, where the bending stresses are much more contained. The sound board according to the invention thus has an overall elasticity which is clearly superior with respect to the boards according to the prior art, and also keeps the critical stresses to much lower levels.

Further features and advantages of the invention will become apparent from the detailed description and reference to the appended drawings briefly described below.

DETAILED DESCRIPTION

Figure 1:
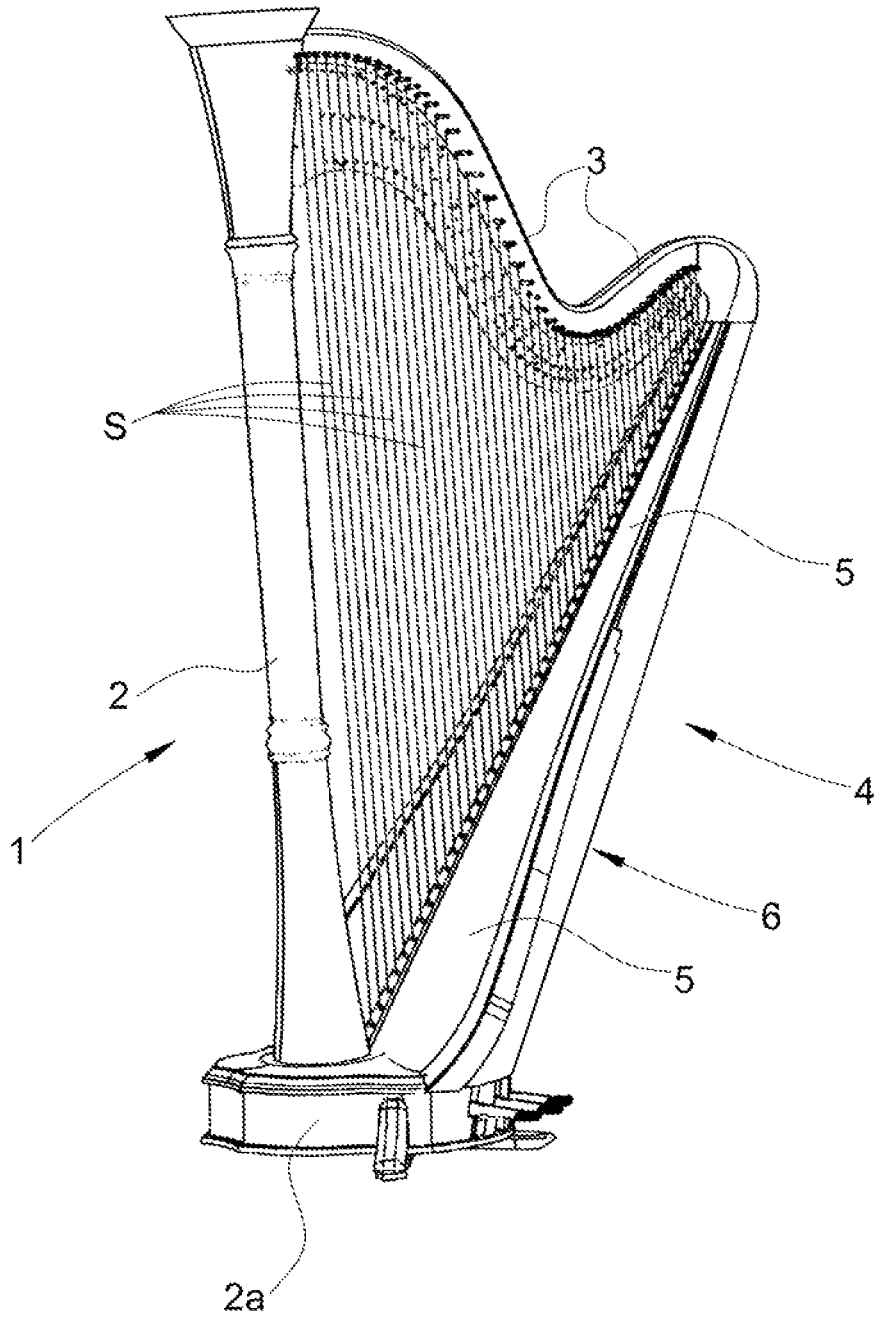
FIG. 1 is a perspective view of a concert harp.

In FIG. 1, a concert harp is designated as a whole by 1. In a manner known per se, this harp comprises an essentially vertical column 2, which extends upwards from a base 2*a*.

What is known as the neck 3 extends from the top portion of the column 2, and the distal end of said neck is joined to the top part of the sound chest, which is designated as a whole by 4.

The sound chest 4 comprises a sound board 5, the peripheral edge of which is bound robustly to a hollow body 6, which generally essentially is shaped like half a truncated cone.

The harp 1 comprises a plurality of strings S, one end of which is fastened to the neck 3 and the other end of which is anchored to the sound board 5.

Figure 2:
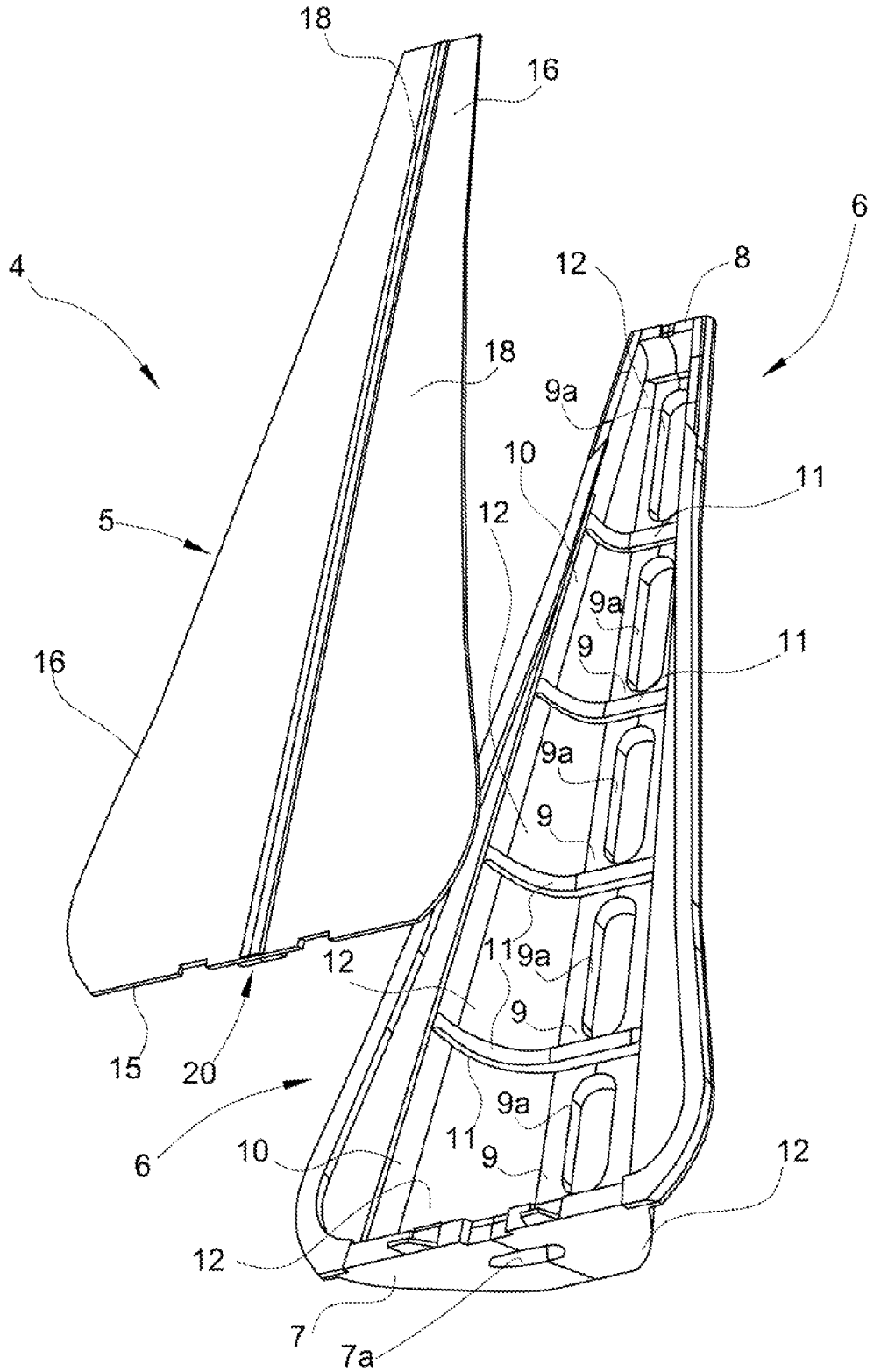
FIG. 2 is a partially exploded perspective view of a sound chest for a harp comprising a sound board according to the present invention.
Figure 4:
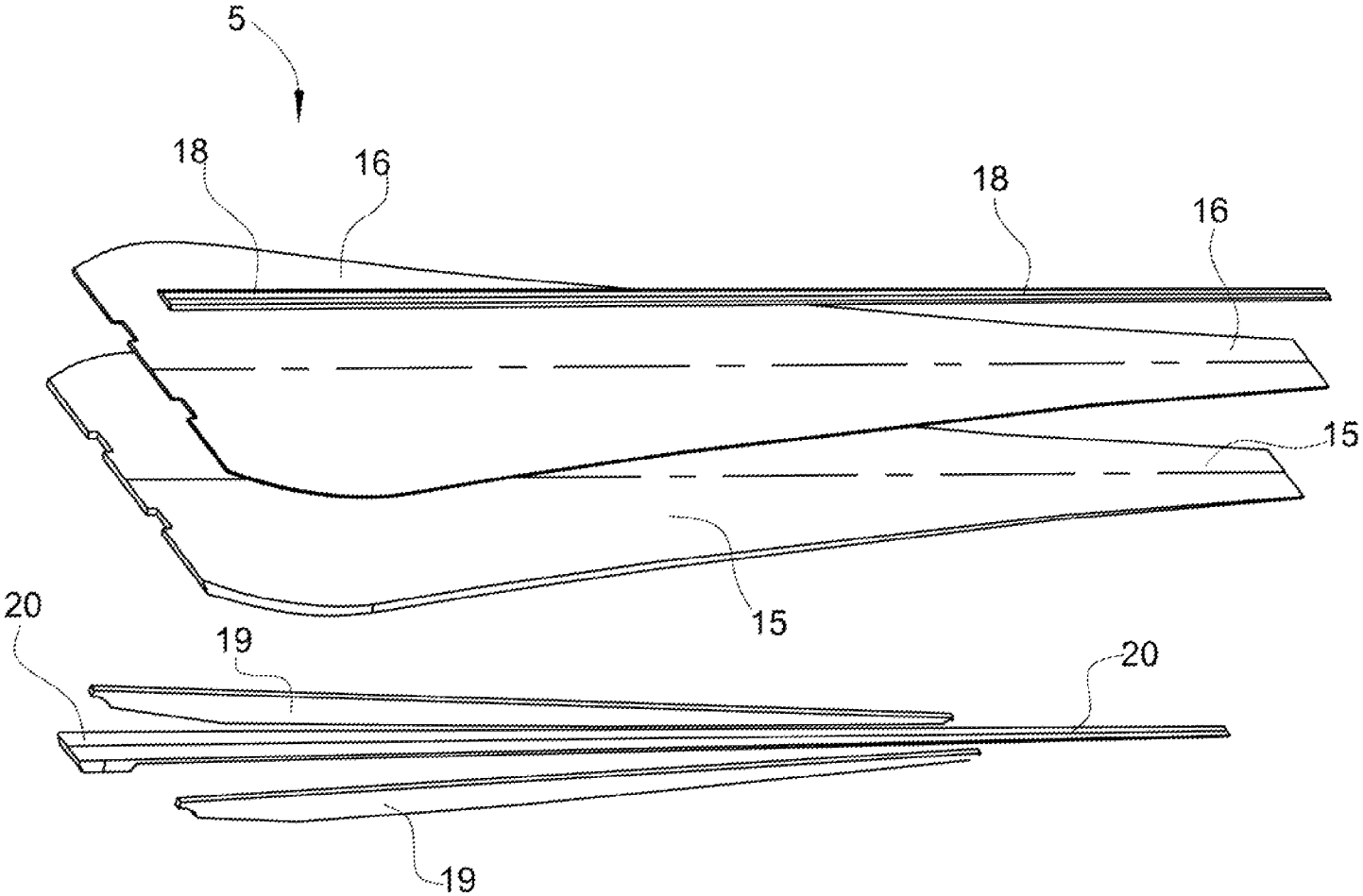
FIG. 4 is an exploded perspective view of the sound board shown in the preceding figures.
Figure 5:
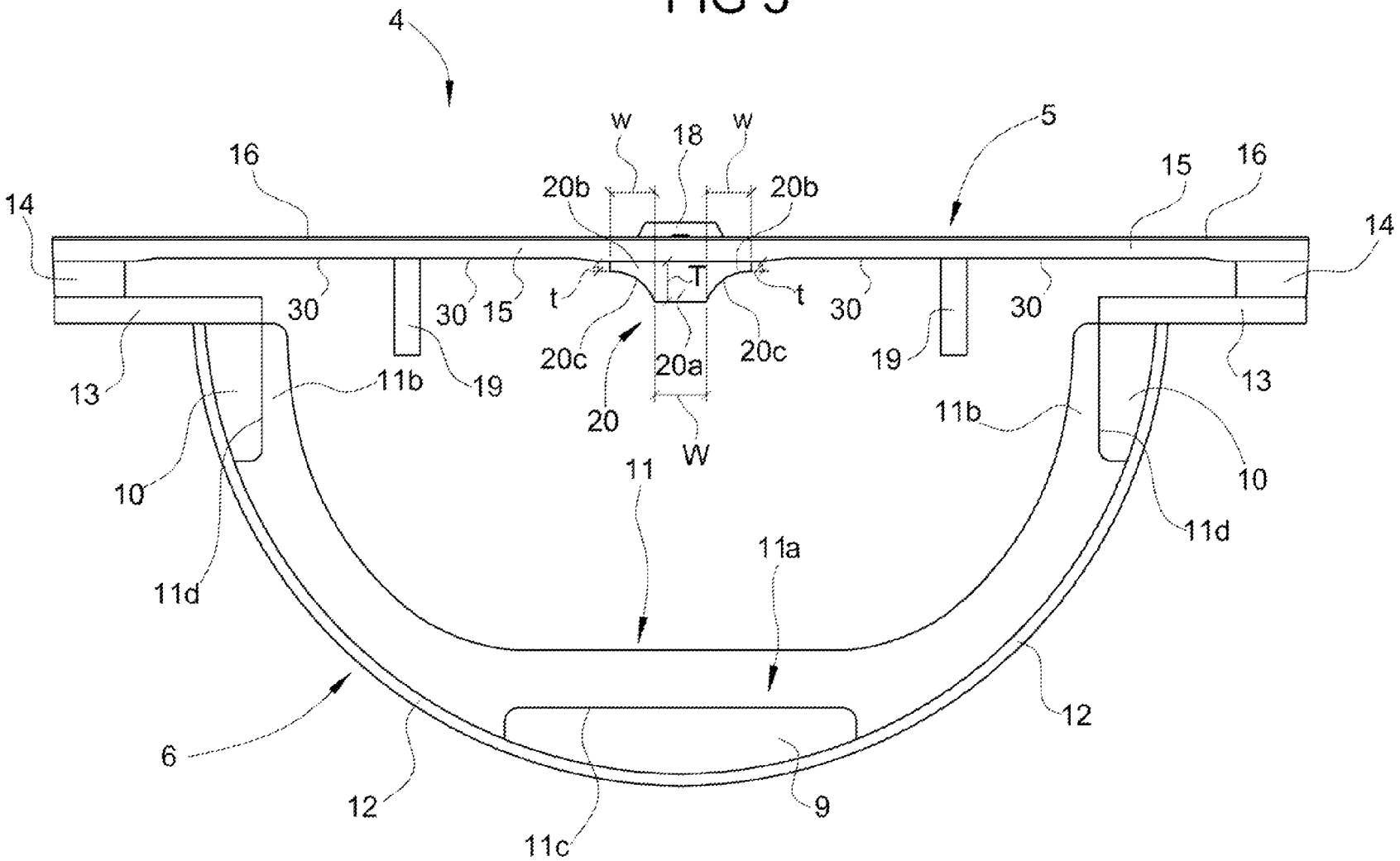
FIG. 5 is a view in transverse cross-section of the sound board shown in the preceding figures.

With reference in particular to FIGS. 2, 4 and 5, in the embodiment illustrated the hollow body 6 of the sound chest 4 has a bearing structure comprising

- a bottom part or chest-bottom 7, which is expediently provided with an opening 7*a*, and a top member or upper block 8; the latter has transverse dimensions which are reduced considerably with respect to those of the chest-bottom 7;

a central longitudinal batten or backboard 9, and two symmetrical side battens or planks 10 (see in particular FIG. 5); the battens 9 and 10 extend between the chest-bottom 7 and the upper block 8; and a plurality of longitudinally staggered, transverse stiffening members or bridges 11; each bridge 11 has an intermediate portion 11*a* connected to the central batten or backboard 9, and end portions 11*b* connected to the side battens or planks 10 (FIG. 5).

In the embodiment illustrated, the bearing structure comprises four bridges 11 and the central batten or backboard 9 has five corresponding openings 9*a* of elongate form, at the ends and between each pair of consecutive bridges 11.

An outer shell 12 is connected to the above-described bearing structure, having approximately the shape of half a truncated cone and formed for example with multi-ply maple wood which is bent and glued to the external surfaces of the backboard 9, of the side battens or planks 10 and of the bridges 11, as well as to the external surfaces of the chest-bottom 7 and of the upper block 8.

As has already been mentioned above, in the sound chest 4 the battens 9, 10 and the bridges 11 have respective portions for mutual engagement, having substantially complementary transverse profiles, at least partially interpenetrated with each other.

With reference in particular to FIG. 5, a recessed seat 11*c* is predisposed for engagement with the central batten or backboard 9 in the intermediate portion 11*a* of each bridge 11, said recessed seat having a transverse profile shaped essentially as a squared channel, complementary to the transverse profile of this batten or backboard 9.

For engagement with the side battens or planks 10, the end portions 11*b* of the bridges 11 have each a recessed seat 11*d*, with an essentially L-shaped transverse profile, preferably with a rounded vertex, complementary to the transverse profile of said side battens or planks 10.

An adhesive is interposed between the recessed seats 11*c* and 11*d* of the bridges and the corresponding surfaces of the longitudinal battens 9 and 10.

The engagement between the battens 9, 10 and the bridges 11 is further strengthened and stabilized by interconnection members, in particular screws or the like, which are advantageously inserted from the outer surface of the battens 9, 10 and which extend through these battens 9, 10 and are then inserted into the bridges 11.

As can be seen in particular in FIG. 5, the transverse profiles of the external surfaces of the bridges 11 and of the battens 9, 10 are joined with each other continuously, so as to form a single arcuate profile in a uniform manner.

As has already been pointed out above, the surfaces of the battens 9, 10 which face towards the inside of the hollow body 6 are expediently flat. The external or outer surfaces thereof may expediently bulge, however, with a relatively contained maximum bending camber of about 2 mm, for example.

The sound board 5, in a manner known per se, has a transverse width which, in the direction of the chest-bottom 7, widens increasingly with respect to that of the shell 12.

The engagement between the peripheral edge of the sound board 5 and the shell 12, and also the relative bearing structure 9-11, is realized by a pair of symmetrical wings 13, for example of plywood, which are glued to the side planks or battens 10 and project outwards beyond the shell 12 (FIG. 5). The distal edges of the wings 13 are connected to the sound board 5 by splints or small bands 14, for example of fir, by adhesive bonding.

Expediently, in a manner known per se, the sound board 5 comprises a main wooden board 15 and an outer ply of veneer 16 (FIGS. 4 and 5). The main board 15 is expediently glued to the wings 13 with the interposition of the splints 14, and the connection is expediently stabilized, for example, by screws, which are screwed from the outside of the board 15 through the splints 14.

A profiled string-carrier member 18 is fastened centrally on the external side or front face of the sound board 5 (FIGS. 2, 4 and 5).

Figure 3:
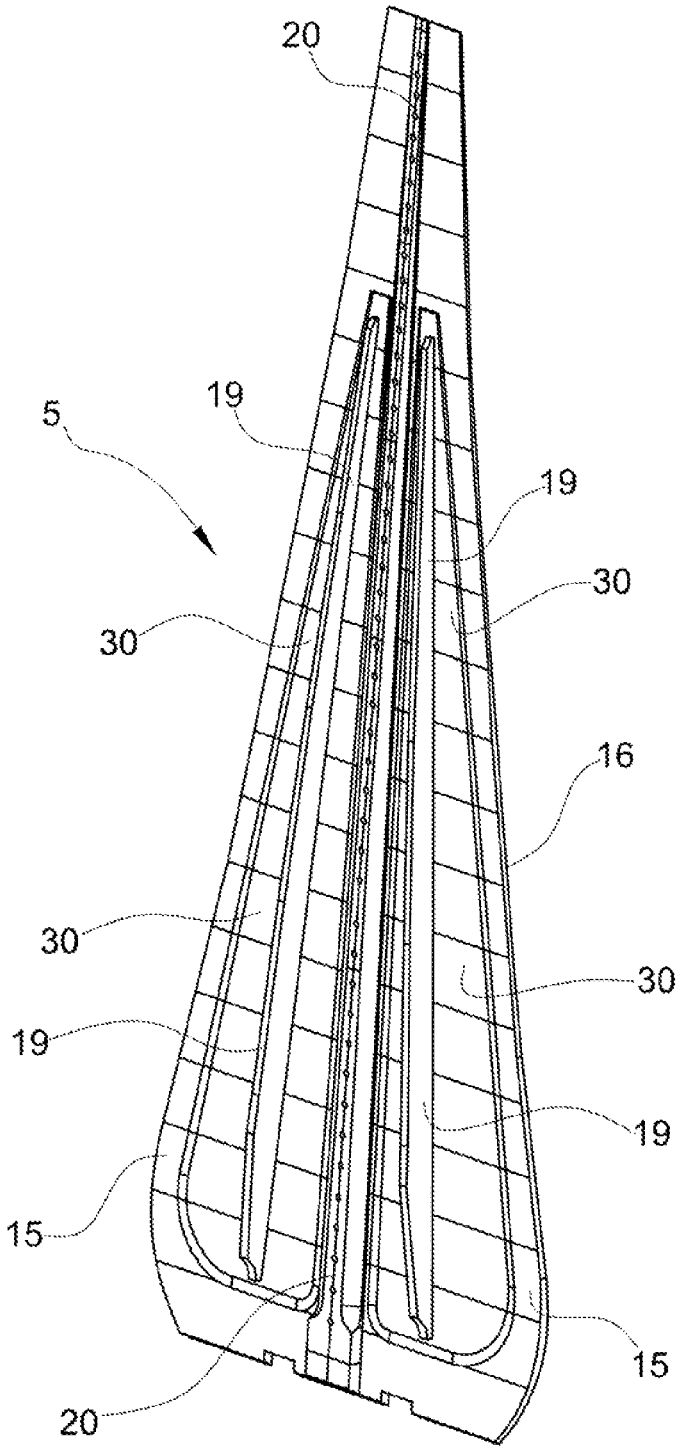
FIG. 3 is a perspective view of the reverse side or back surface of the sound board shown in FIG. 2.

A longitudinal profiled reinforcing member or beam 20 is fastened centrally on the back surface or reverse side of the board 5, and two side profiled members or sound bars 19 are fastened symmetrically at a certain distance from the sides thereof (see in particular FIGS. 3 and 5).

As can be seen more clearly in FIG. 5, the reinforcing beam 20 has an essentially rectangular central portion 20*a* with an increased height or thickness and two adjacent, symmetrical side portions or wings 20*b* having a height or thickness which tapers gradually towards the outside. The tapering of the height or thickness of the side wings 20*b* follows a concave arcuate profile 20*c*, facing away from the board 15, and reaches a predetermined minimum value at the external ends of said wings.

The minimum value t of the height or thickness of the side wings 20*b* of the reinforcing beam 20 is expediently comprised between 1 and 5 mm.

In addition, at least in the lower half of the reinforcing beam (i.e. in the half adjacent to the chest-bottom), the transverse width w of each of the side wings 20*b* of the reinforcing beam 20 is expediently comprised between about 2/3 and 3/3 of the transverse width W of the central portion 20*a*.

In this lower half, the reinforcing beam 20 is therefore transversely wider and more shallow or thin with respect to those of the sound boards according to the prior art. As a result, the transverse bending stress peaks during loading of the board, which are typically located at the end steps of the side portions or wings 20*b*, are reduced considerably.

With reference in particular to FIGS. 3 and 5, on the reverse side or back surface of the main wooden board 15 between the reinforcing beam 20 and each longitudinal side edge of said board 15 there is formed a lightening recess 30 which in plan view has an essentially triangular shape (FIG. 3). A respective sound bar 19 extends in each of the recesses 30.

The lightening recesses 30 are such that in said recesses the thickness of the wooden board 15 is reduced by an amount which varies between 1% in the proximity of the upper block 8 and 25% in the proximity of the chest-bottom 7.

This solution makes it possible to make the sound board 5 more elastic as a whole, and makes it possible to transfer some of the deformation of this board, and therefore of the transverse stresses, from the region of the reinforcing beam 20 towards the sound bars 19, where the bending stresses are generally much more contained.

The sound board 5 according to the invention thus has an overall elasticity which is clearly superior with respect to the boards according to the prior art, and also keeps the critical stresses to much lower levels.

The weight of the sound board is also reduced significantly.

Clearly, without departing from the principle of the invention, the embodiments and details of construction may differ considerably from those described and illustrated purely by way of non-restrictive example, without thereby departing from the scope of the invention as defined in the appended claims.

The invention claimed is:

1. A sound board for a harp, comprising a wooden board having an elongate, approximately trapezoid shape provided on a front face with a central longitudinal profiled string-carrier member and on a reverse side with a central profiled reinforcing member or beam, made of a wooden material and with two side profiled members or sound bars, symmetrically disposed with respect to said reinforcing beam, and wherein a cross-section of said reinforcing beam has a central portion with an increased height or thickness and two adjacent, symmetrical side portions or wings having a height or thickness which tapers gradually towards outside through a concave arcuate profile up to a predetermined minimum value;

wherein said minimum value of the height or thickness of the side portions or wings of said reinforcing beam is between about 1 and about 5 mm, and wherein at least in a lower half of said reinforcing beam the transverse width of each of said side portions or wings of said einforcing beam is between about 2/3 and about 3/3 of the transverse width of said central portion.

2. The sound board of claim 1, wherein on the reverse side or back surface of said wooden board between the central reinforcing beam and each longitudinal side edge of said board there is formed a lightening recess which in plan view has an essentially triangular shape, from which a corresponding sound bar extends.

3. The sound board of claim 2, wherein in said recesses the thickness of the wooden board is reduced by an amount between about 1% and about 25%.

* * * * *